US005144724A

United States Patent [19]

Chuan

[11] Patent Number: 5,144,724

[45] Date of Patent: Sep. 8, 1992

[54] BUCKLE FOR LOCKING STRAP

[76] Inventor: Chiang C. Chuan, 4th Fl., No. 23, Alley 1, Lane 285, Sec. 1, Wenhua Rd., Panchiao City, Taipei County, Taiwan

[21] Appl. No.: 838,690

[22] Filed: Feb. 21, 1992

[51] Int. Cl.[5] ..... A44B 11/00; B60P 7/00

[52] U.S. Cl. ..... 24/68 CD; 24/197; 410/110

[58] Field of Search ..... 24/68 CD, 68 R, 68 E, 24/69 SB, 17 R, 19, 197, 198, 302, 372; 410/110, 116, 105, 104, 108, 109, 111

[56] References Cited

U.S. PATENT DOCUMENTS

| | | | |
|---|---|---|---|
| 327,731 | 10/1885 | Sinclair | 24/197 |
| 3,672,004 | 6/1972 | Smith | 24/302 |
| 3,713,616 | 1/1973 | Bowers | 410/105 |
| 4,118,833 | 10/1978 | Knox et al. | 24/68 CD |
| 4,185,360 | 1/1980 | Prete, Jr. et al. | 24/68 CD |
| 4,191,108 | 3/1980 | Jones | 410/110 |
| 4,823,443 | 4/1989 | Waters | 24/68 CD |
| 5,063,641 | 11/1991 | Chuan | 24/68 CD |

*Primary Examiner*—Victor N. Sakran
*Attorney, Agent, or Firm*—Leydig, Voit & Mayer

[57] ABSTRACT

A buckle cooperating with two straps each having a hooked end and a free end for fastening goods on a truck or the like. The buckle has a body and two rings. The body has two rectangular walls each having two longitudinal slots at two opposite ends thereof, two clefts each communicating with one of the slots, and at transverse middle cutoff. The walls are connected to each other with two bars below the slots and a flat element below the cutoff, thereby forming two openings beside the flat element. Each ring has a flat member. The hooked end of each strap is attached to a different side of the truck. The free ends of the straps are (a) inserted through the openings, (b) wound around the flat members of the rings, (c) inserted between the flat members of the rings and the bars, and (d) disposed between the bar and the strap. The flat member has an unlocking position where the strap can be pulled and a locking position where the strap is locked.

2 Claims, 3 Drawing Sheets

BUCKLE FOR LOCKING STRAP

BACKGROUND OF THE INVENTION

The present invention relates to a buckle for locking straps for fastening goods loaded onto a truck or the like.

Conventionally, goods which are served to a truck or the like are bound with a rope made out of jute or the like. A first end of the rope is attached to a hook on one side of the truck or the like. The rope is wound around the goods and wrapped around another hook on the opposite side of the truck. The rope is finally tied into a knot on the hook located at the opposite side of the truck. The goods are thus fastened. The trouble with using a rope is that time is wasted when winding the rope around the goods; it is not always easy to tie a firm knot to secure the goods; and the roughness of the rope can easily damage the goods.

U.S. Pat. No. 4,118,833 discloses a buckle assembly with a strap-tightening mechanism where in a padlock is needed to fix a handle member and a main frame in a secure position. Disadvantageously, such a buckle has a high cost and the weight thereof is so substantial that the buckle may cause serious damage to the goods.

U.S. Pat. No. 4,185,360 discloses a ratchet buckle for tightening and tensioning strap wherein ratchet wheels and two spring-biased latching plates are employed to tighten the strap. It is very difficult to disengage the two latching plates from the ratchet wheels simultaneously; thus, it is very difficult to loosen the strap.

SUMMARY OF THE INVENTION

The present invention provides a buckle cooperating with two straps each having a hooked end and a free end for fastening goods onto a truck or the like. The buckle has a body and two rings. The body has two rectangular walls each having two longitudinal slots at two opposite ends thereof, two clefts each communicating with one of the slots, and a transverse middle cutoff. The walls are connected to each other with two bars disposed below the slots and a flat element located below the cutoff, thereby forming two openings beside the flat element. Each ring has a flat member. The hooked end of each strap is attached to a different side of the truck. The free ends of the straps are (a) inserted through the openings, (b) wound around the flat members of the rings, (c) inserted between the flat members of the rings and the bars, and (d) disposed between the bar and the strap. The flat member has an unlocking position where the strap can be pulled and a locking position where the strap is locked.

For a better understanding of the present invention and objects thereof, a study should be made to the detailed description of below-mentioned embodiments, in relation to the accompanying drawings.

DETAILED DESCRIPTION OF THE PREFERRED EMBODIMENT

Figure 1:
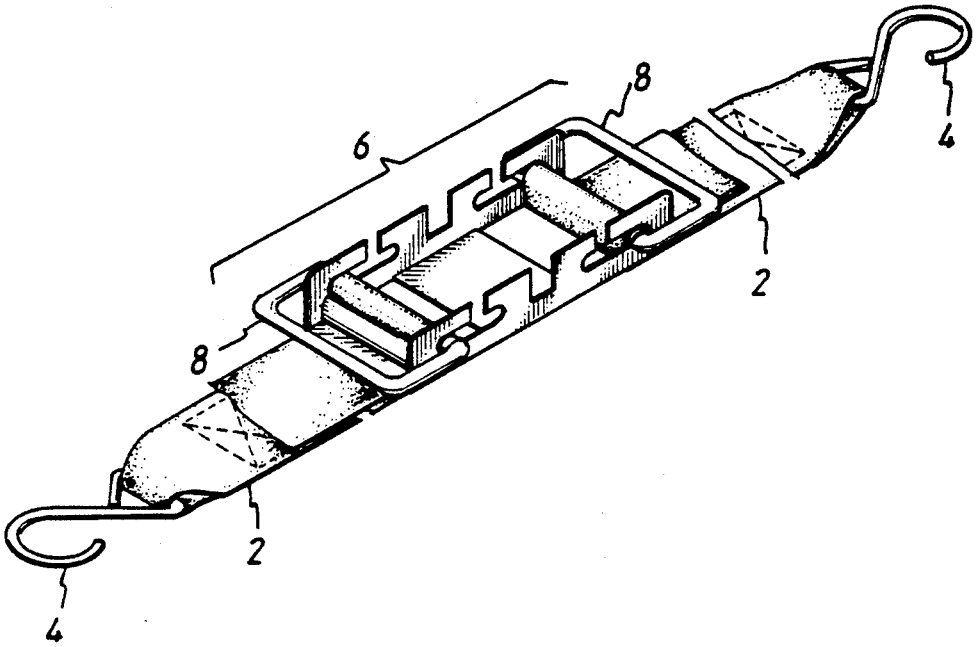
FIG. 1 is a perspective view of a buckle cooperating with a strap in accordance with the present invention.

Referring to the drawings, and, more specifically, to FIG. 1, a strap 2 has a first end and a second end. The first end of the strap 2 is bound with a hook 4. The second end of the strap 2 is a free end. In use, two straps 2 and a buckle 6 are employed. The hook 4 of a strap 2 is attached to a hook formed on a side of a truck or the like (not shown) while the hook 4 of the other strap 2 is attached to a hook formed on an opposite side of the truck. The free ends of the straps 2 are secured in the buckle 6, thereby fastening goods (not shown) on the truck.

Figure 2:
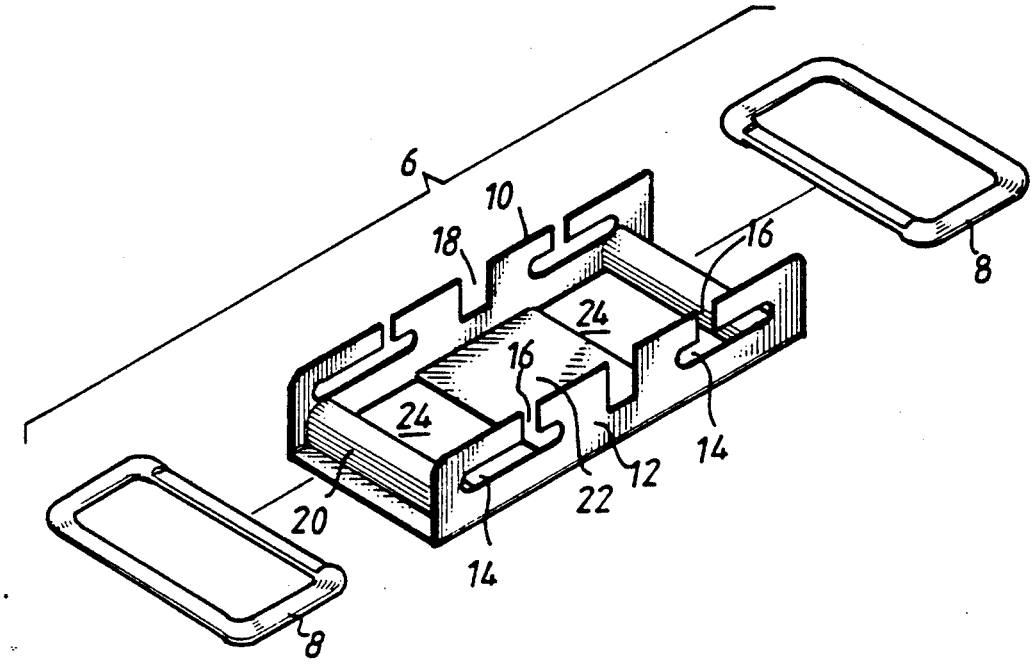
FIG. 2 is a perspective view of a buckle in accordance with the present invention.

Referring to FIG. 2, the buckle 6 has two rectangular rings 8 and a body 10. The ring 8 has four members, thereby defining a plane. One of the members is a flat member which is parallel to the plane defined by the members of the ring 8.

The body 10 has two identical rectangular walls 12 extending parallel to each other. Each wall 12 defines two slots 14 extending on a length thereof in the vicinity of two opposite ends thereof, two clefts 16 each communicating with a slot 14, and a cutoff 18 extending perpendicular to the length between the slots 14. The cutoff 18 is twice as wide as the slot 14 and the cleft 16.

The walls 12 are rigidly connected to each other with two bars 20 and a flat element 22 between the bars 20, so as to form two openings 24. The bars 20 extend perpendicular to the walls 12 below the slots 14. The flat element 22 extends below the cutoffs 18.

Figure 3:
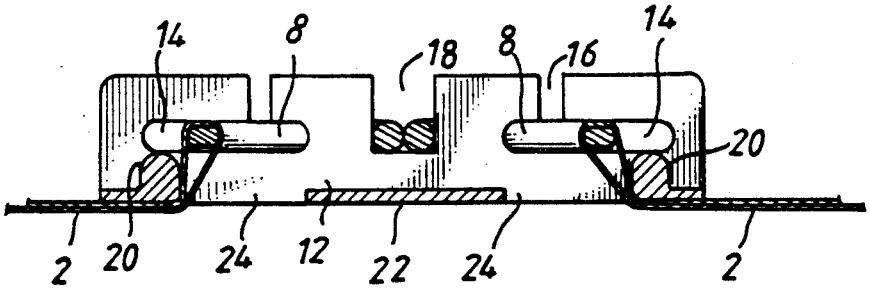
FIG. 3 is a cross-sectional view of a buckle in a locking position in accordance with the present invention.

Referring to FIG. 3, the flat member of each ring 8 is received in the slots 14 while a member opposite to the flat member is received in the cutoff 18. The free end of each strap 2 is (a) inserted upward through an opening 24, (b) wound around the flat member of a ring 8, (c) directed downward through the opening 24, and (d) disposed between the bar 20 and the remaining portion of the strap 2. The ring 8 is in an unlocking position in the slot 14. When the strap 2 is subject to a tensional force which is apt to loosen the strap 2, the normal forces respectively between the free end and the remaining portion of the strap 2 and between the free end of the strap 2 and the bar 20 increase a small amount, i.e., the frictional forces respectively between the free end and the remaining portion of the strap 2 and between the free end of the strap 2 and the bar 20 increase a small amount. The frictional forces can be overcome by the tensional force, thereby allowing the strap 2 to be loosened.

Figure 4:
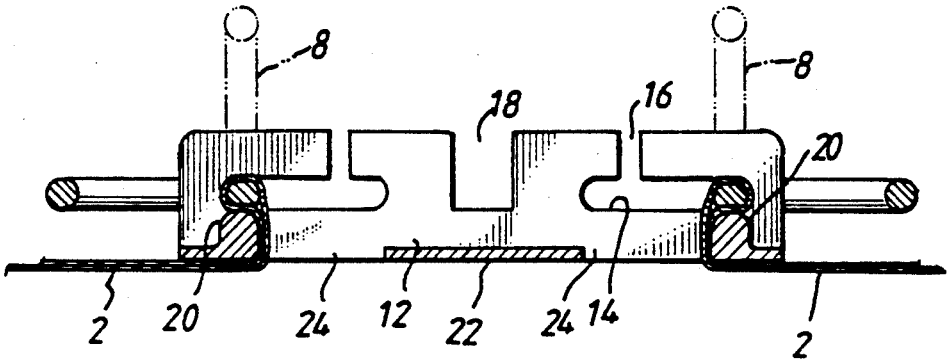
FIG. 4 is a cross-sectional view of a buckle in an unlocking position in accordance with the present invention.

Referring to FIG. 4, the free ends of the straps are pulled, thereby fastening goods on the truck. The rings 8 are placed in their locking positions in the slots 14, where the flat member of the rings 8 are located immediately above the bars 20. When the strap 2 is subject to a terminal force which is apt to loosen the strap 2, the remaining portion of the strap 2 compresses the free end of the strap 2 against the bar 20, thus the normal forces are increased respectively between the free end and the remaining portion of the strap 2 and between the free end of the strap 2 and the bar 20, i.e., increasing the friction respectively between the free end and the remaining portion of the strap 2 and between the free end of the strap 2 and the bar 20. The tensional force cannot overcome the frictional forces, so that the strap 2 remains locked. To unlock the strap 2, the rings 8 are pivoted toward their unlocking positions, thereby loosening the straps 2.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A buckle cooperating with two straps each having a hooked end attached to a different side of a truck and a free end secured in said buckle for fastening goods on the truck, comprising:

a body comprising:

two parallel rectangular walls each defining two slots extending in a length thereof at two ends thereof, two clefts each communicating with one said slot; and a cutoff extending perpendicular to the length between said slots; and two bars connecting said walls below said slots; and two rings each comprising a flat straight member having a locking position and an unlocking position in one said slot.

2. A buckle in accordance with claim 1, further comprising an element between said bars for enforcing the connection between said walls.

* * * * *